US009341987B2

(12) United States Patent
Maruyama

(10) Patent No.: US 9,341,987 B2
(45) Date of Patent: May 17, 2016

(54) DEVELOPMENT ROLLER, DEVELOPING DEVICE, AND IMAGE FORMING APPARATUS

(71) Applicant: FUJI XEROX CO., LTD., Tokyo (JP)

(72) Inventor: Akihisa Maruyama, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/615,105

(22) Filed: Feb. 5, 2015

(65) Prior Publication Data

US 2015/0261135 A1 Sep. 17, 2015

(30) Foreign Application Priority Data

Mar. 14, 2014 (JP) ..... 2014-051972

(51) Int. Cl.
*G03G 15/08* (2006.01)
*G03G 15/09* (2006.01)

(52) U.S. Cl.
CPC .... *G03G 15/0921* (2013.01); *G03G 2215/0838* (2013.01)

(58) Field of Classification Search
CPC ..... G03G 15/0928; G03G 15/0818; G03G 15/0921; G03G 2215/0609; G03G 2215/0634
USPC ..... 399/276
See application file for complete search history.

(56) References Cited

U.S. PATENT DOCUMENTS 5,452,041 A * 9/1995 Claes et al. ..... 396/604
2003/0170050 A1* 9/2003 Terai ..... 399/267

FOREIGN PATENT DOCUMENTS

JP 2005-017972 A 1/2005

* cited by examiner

*Primary Examiner* — Walter L Lindsay, Jr.
*Assistant Examiner* — Frederick Wenderoth
(74) *Attorney, Agent, or Firm* — Oliff PLC

(57) ABSTRACT

A development roller includes a substantially cylindrical development sleeve that has an axis and rotates about the axis; and a magnet portion that is provided in the development sleeve and has plural magnetic poles. The development sleeve has a surface and a groove in the surface along a direction of the axis. The development sleeve has an outer peripheral surface and the groove has a bottom portion, the development sleeve having a deflection of the outer peripheral surface in a radial direction of the development sleeve being larger than about 20 μm and smaller than about 30 μm, and a deflection of the bottom portion in the radial direction being equal to or smaller than about 35 μm.

4 Claims, 10 Drawing Sheets

FIG. 11

| | OUTER-PERIPHERAL-SURFACE DEFLECTION (μm) | GROOVE DEFLECTION (μm) |
|---|---|---|
| EXAMPLE 1 | 27 | 31 |
| EXAMPLE 2 | 23 | 30 |
| EXAMPLE 3 | 23 | 30 |
| EXAMPLE 4 | 21 | 27 |
| EXAMPLE 5 | 25 | 31 |
| EXAMPLE 6 | 26 | 33 |
| COMPARATIVE EXAMPLE 1 | 12 | 18 |
| COMPARATIVE EXAMPLE 2 | 8 | 17 |
| COMPARATIVE EXAMPLE 3 | 7 | 17 |
| COMPARATIVE EXAMPLE 4 | 20 | 25 |
| COMPARATIVE EXAMPLE 5 | 13 | 19 |
| COMPARATIVE EXAMPLE 6 | 35 | 42 |
| COMPARATIVE EXAMPLE 7 | 30 | 35 |
| COMPARATIVE EXAMPLE 8 | 21 | 36 |
| COMPARATIVE EXAMPLE 9 | 16 | 21 |
| COMPARATIVE EXAMPLE 10 | 15 | 21 |

DEVELOPMENT ROLLER, DEVELOPING DEVICE, AND IMAGE FORMING APPARATUS

CROSS-REFERENCE TO RELATED APPLICATIONS

This application is based on and claims priority under 35 USC 119 from Japanese Patent Application No. 2014-051972 filed Mar. 14, 2014.

BACKGROUND (i) Technical Field

The present invention relates to a development roller, a developing device, and an image forming apparatus.

(ii) Related Art

There is known a technology that improves deflection precision of a development sleeve.

SUMMARY

According to an aspect of the invention, there is provided a development roller including a substantially cylindrical development sleeve that has an axis and rotates about the axis; and a magnet portion that is provided in the development sleeve and has plural magnetic poles. The development sleeve has a surface and a groove in the surface along a direction of the axis. The development sleeve has an outer peripheral surface and the groove has a bottom portion, the development sleeve having a deflection of the outer peripheral surface in a radial direction of the development sleeve being larger than about 20 μm and smaller than about 30 μm, and a deflection of the bottom portion in the radial direction being equal to or smaller than about 35 μm.

BRIEF DESCRIPTION OF THE DRAWINGS

An exemplary embodiment of the present invention will be described in detail based on the following figures, wherein:

FIG. 11 illustrates outer-peripheral-surface deflections and groove deflections of development rollers according to Examples 1 to 6 and development rollers according to Comparative Examples 1 to 10;

DETAILED DESCRIPTION

Configuration of Image Forming Apparatus 1

Figure 1:
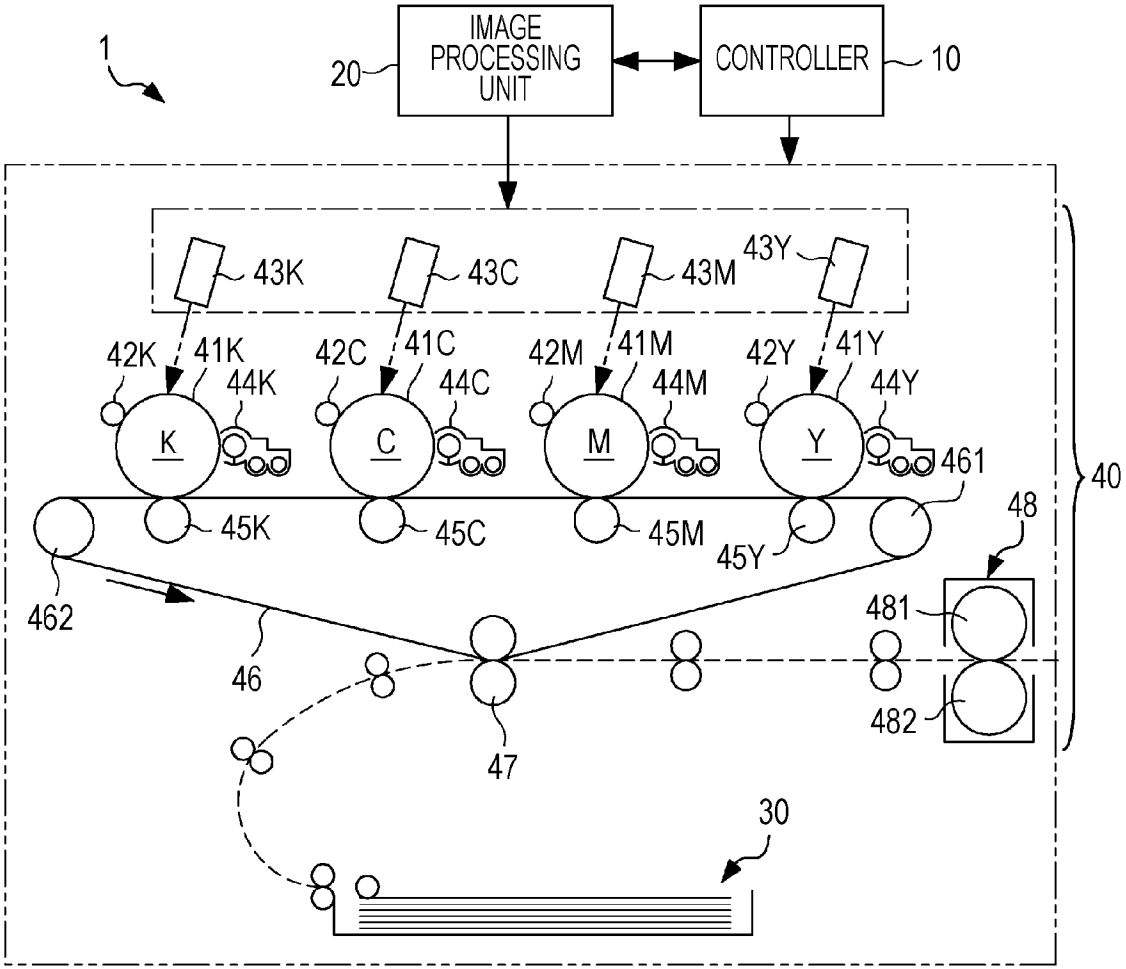
FIG. 1 illustrates a configuration of an image forming apparatus.

FIG. 1 illustrates a configuration of an image forming apparatus 1. The image forming apparatus 1 forms an image on a recording medium by an electrophotographic system. The image forming apparatus 1 includes a controller 10, an image processing unit 20, a paper feeding unit 30, and an image forming unit 40.

The controller 10 includes a central processing unit (CPU), a read only memory (ROM), and a random access memory (RAM). The CPU causes the RAM to read a program stored in the ROM and executes the program, and hence the controller 10 controls the respective units of the image forming apparatus 1. The image processing unit 20 applies various image processing on input image data and outputs the image data. The paper feeding unit 30 houses plural recording media. The paper feeding unit 30 sends the housed recording media one by one. The recording medium sent from the paper feeding unit 30 is transported to the image forming unit 40.

The image forming unit 40 includes photoconductor drums 41Y, 41M, 41C, and 41K; charging devices 42Y, 42M, 42C, and 42K; exposure devices 43Y, 43M, 43C, and 43K; developing devices 44Y, 44M, 44C, and 44K; first transfer rollers 45Y, 45M, 45C, and 45K; an intermediate transfer belt 46; a second transfer roller 47; and a fixing device 48.

A photosensitive layer is formed on each of surfaces of the photoconductor drums 41Y, 41M, 41C, and 41K. The photoconductor drums 41Y, 41M, 41C, and 41K are driven by driving units (not shown), and rotate about their axes. The photoconductor drums 41Y, 41M, 41C, and 41K are each an example of a photoconductor. The charging devices 42Y, 42M, 42C, and 42K charge the surfaces of the photoconductor drums 41Y, 41M, 41C, and 41K with electricity at a predetermined potential. The exposure devices 43Y, 43M, 43C, and 43K expose the charged surfaces of the photoconductor drums 41Y, 41M, 41C, and 41K to light and form electrostatic latent images in accordance with the image data output from the image processing unit 20. The developing devices 44Y, 44M, 44C, and 44K develop the electrostatic latent images formed on the photoconductor drums 41Y, 41M, 41C, and 41K by using toners of yellow, magenta, cyan, and black, and form toner images. The first transfer rollers 45Y, 45M, 45C, and 45K transfer the toner images formed on the photoconductor drums 41Y, 41M, 41C, and 41K to the intermediate transfer belt 46.

The intermediate transfer belt 46 is supported by a driving roller 461 and a backup roller 462. The intermediate transfer belt 46 is driven and rotated by the driving roller 461. The toner images transferred from the photoconductor drums 41Y, 41M, 41C, and 41K are transported to the second transfer roller 47 by the rotation of the intermediate transfer belt 46. The second transfer roller 47 transfers the toner images formed on the intermediate transfer belt 46 to the recording medium transported from the paper feeding unit 30. The second transfer roller 47 is an example of a transfer device. The fixing device 48 includes a fixing roller 481 and a pressing roller 482. The fixing device 48 fixes the toner images to the recording medium by applying heat and pressure to the toner images on the recording medium by the fixing roller 481 and the pressing roller 482.

In the following description, the photoconductor drums 41Y, 41M, 41C, and 41K are collectively called "photoconductor drum 41" unless otherwise the photoconductor drums 41Y, 41M, 41C, and 41K are required to be distinguished from each other. Similarly, the developing devices 44Y, 44M, 44C, and 44K are collectively called "developing device 44" unless otherwise the developing devices 44Y, 44M, 44C, and 44K are required to be distinguished from each other.

Configuration of Developing Device 44

Figure 2:
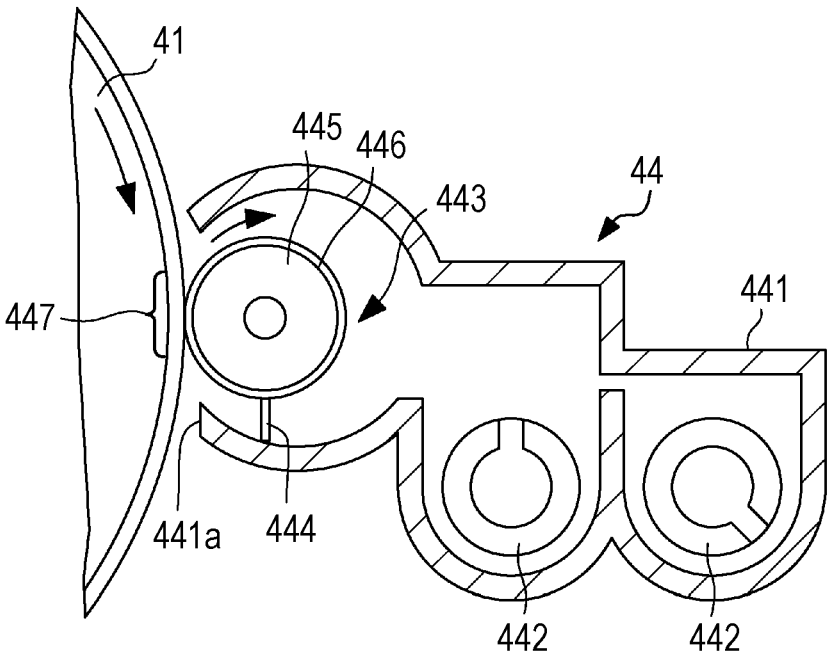
FIG. 2 illustrates a configuration of a developing device.

FIG. 2 illustrates a configuration of the developing device 44. The developing device 44 includes a housing portion 441, plural stirring and transporting members 442, a development roller 443, and a restricting member 444.

The housing portion 441 houses a developer containing a toner and a carrier. The housing portion 441 has an opening 441*a* at a position at which the housing portion 441 faces the photoconductor drum 41. The plural stirring and transporting members 442 are provided in the housing portion 441. The plural stirring and transporting members 442 each has a shaft and a spiral blade provided on the peripheral surface of the shaft. The stirring and transporting members 442 are each driven by a driving unit (not shown) and each rotate about the shaft. Accordingly, the stirring and transporting members 442 transport the developer housed in the housing portion 441 to the development roller 443 while stirring the developer.

The development roller 443 is provided at the opening 441*a* of the housing portion 441. The development roller 443 includes a magnet roller 445 and a development sleeve 446. The magnet roller 445 is provided in a fixed state to the shaft of the development roller 443 in the development sleeve 446. An N-pole and an S-pole are arranged at the magnet roller 445 with a predetermined pattern in the circumferential direction of the magnet roller 445. The magnet roller 445 is an example of a magnet portion having plural magnetic poles. The development sleeve 446 is a hollow cylindrical member or a hollow substantially cylindrical member that surrounds the outer peripheral surface of the magnet roller 445. For example, the development sleeve 446 has a diameter of about 16 mm or about 18 mm. The development sleeve 446 is driven by a driving unit (not shown) and rotates about the axis along the outer peripheral surface of the magnet roller 445. Also, a voltage is applied from a power supply (not shown) to the development sleeve 446. The restricting member 444 restricts the layer thickness of the developer held on the development roller 443.

The developer housed in the housing portion 441 is transported to the development roller 443 by the stirring and transporting members 442, and adheres to the surface of the development roller 443. The developer forms a magnetic brush in a standing grass shape on the surface of the development roller 443. By the rotation of the development roller 443, the developer is transported to a development region 447. The restricting member 444 restricts the layer thickness of the developer while the transportation of the developer. When the developer reaches the development region 447, the toner contained in the developer is transferred to a portion of an electrostatic latent image formed on the photoconductor drum 41 due to a potential difference between the photoconductor drum 41 and the development roller 443. Accordingly, an electrostatic latent image is developed.

Configuration of Development Sleeve 446

Figure 3:
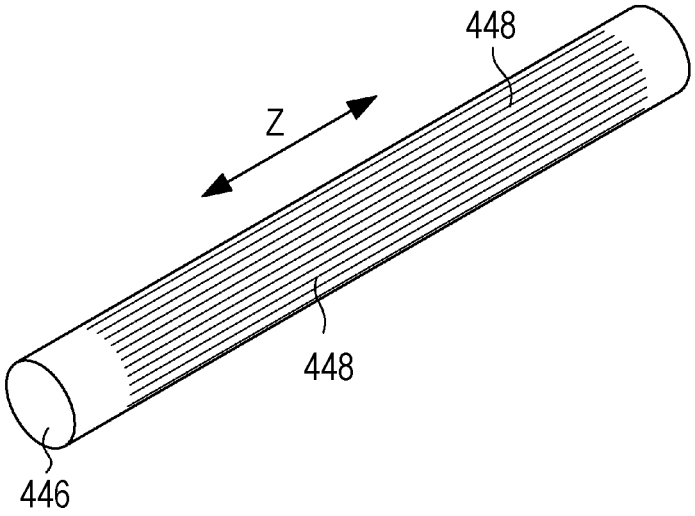
FIG. 3 illustrates an example of a development sleeve.

FIG. 3 illustrates an example of the development sleeve 446. The development sleeve 446 has plural grooves 448 in the outer peripheral surface thereof. The grooves 448 extend in the axial direction (arrow Z direction) and arranged at a predetermined interval. The axial direction indicates a direction in which the axis extends. The number of grooves 448 is, for example, 64. The grooves 448 each have a depth of, for example, about 100 μm. The groove 448 has a V-shaped cross section. Alternatively, the cross-sectional shape of the groove 448 may be a U shape, a rectangular shape, or other shape.

If the outer peripheral surface of the development sleeve 446 has a deflection in the radial direction (hereinafter, referred to as "outer-peripheral-surface deflection"), density unevenness is generated in a developed image. The outer-peripheral-surface deflection indicates the magnitude of a displacement of the outer peripheral surface in the radial direction at a certain position when the development sleeve 446 is rotated. Also, if a bottom portion of the groove 448 of the development sleeve 446 has a deflection in the radial direction (hereinafter, referred to as "groove deflection"), density unevenness is generated in a developed image. The groove deflection indicates the magnitude of a displacement of the bottom portion of the groove 448 in the radial direction at a certain position when the development sleeve 446 is rotated.

Figure 4:
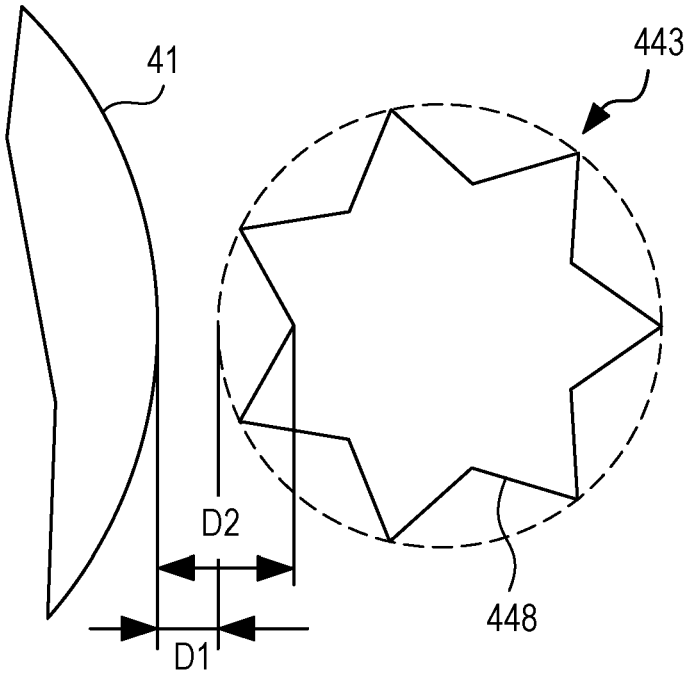
FIG. 4 is an explanatory illustration explaining a mechanism that generates density unevenness of an image due to an outer-peripheral-surface deflection and a groove deflection.

FIG. 4 is an explanatory illustration explaining a mechanism that generates density unevenness of an image due to an outer-peripheral-surface deflection and a groove deflection. In FIG. 4, the grooves 448 of the development sleeve 446 are illustrated in an enlarged manner as compared with the actual size for easier understanding of the description. If the development sleeve 446 has an outer-peripheral-surface deflection, when the development roller 443 rotates, a distance D1 between the photoconductor drum 41 and the outer peripheral surface of the development roller 443 varies. If the development sleeve 446 has a groove deflection, when the development roller 443 rotates, a distance D2 between the photoconductor drum 41 and the bottom portion of the groove 448 of the development roller 443 varies. As described above, if the distance D1 or D2 varies, the electric field between the photoconductor drum 41 and the development roller 443 varies, and density unevenness is generated in a developed image.

In this exemplary embodiment, the outer-peripheral-surface deflection is preferably larger than 20 μm and smaller than 30 μm, or larger than about 20 μm and smaller than about 30 μm; and the groove deflection is preferably equal to or smaller than 35 μm, or equal to or smaller than about 35 μm. The outer-peripheral-surface deflection is more preferably larger than 20 μm and equal to or smaller than 25 μm, or larger than about 20 μm and equal to or smaller than about 25 μm; and the groove deflection is more preferably equal to or smaller than 35 μm, or equal to or smaller than about 35 μm. These values are allowed to have errors by certain degrees.

Measurement Method of Outer-Peripheral-Surface Deflection

Figure 5:
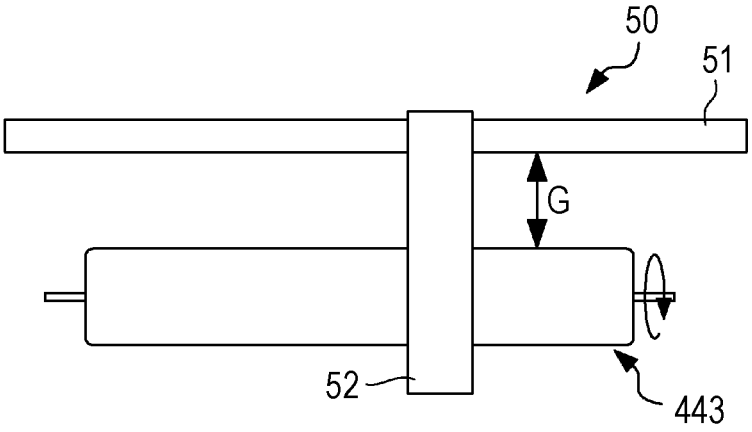
FIG. 5 illustrates an example of a method of measuring an outer-peripheral-surface deflection.

FIG. 5 illustrates an example of a method of measuring an outer-peripheral-surface deflection. In the example shown in FIG. 5, an outer-peripheral-surface deflection is measured by using a deflection measurement device 50. FIG. 5 illustrates a state of the deflection measurement device 50 and the development roller 443 viewed from the upper side. The deflection measurement device 50 includes a straight edge 51 serving as a reference and a laser sensor 52. The laser sensor 52 measures a gap amount G between the straight edge 51 and the rotating development roller 443. The height in the radial direction of the outer peripheral surface of the development sleeve 446 is obtained on the basis of the gap amount G measured by the deflection measurement device 50 and the distance between the straight edge 51 and the axis of the development roller 443.

Figure 6:
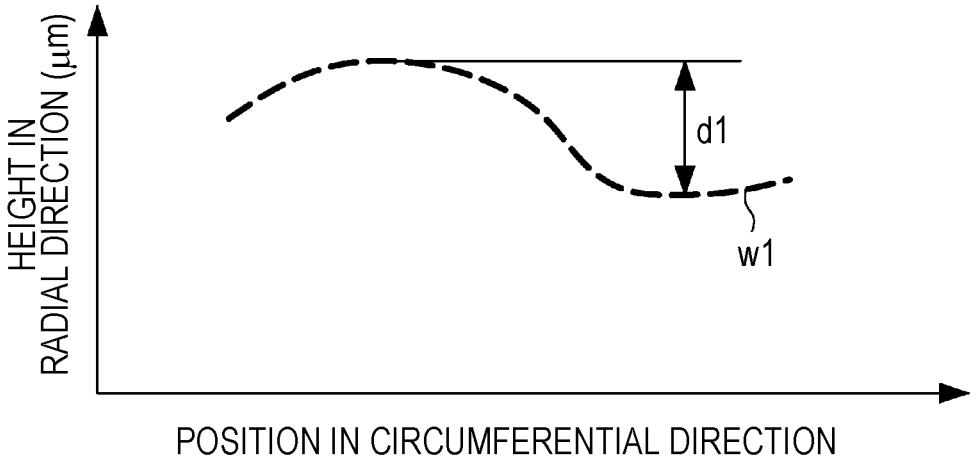
FIG. 6 illustrates an example of a waveform indicative of a measurement result of a deflection measurement device.

FIG. 6 illustrates an example of a waveform w1 indicative of a measurement result of the deflection measurement device 50. In FIG. 6, the horizontal axis indicates the position in the circumferential direction of the development sleeve 446, and the vertical axis indicates the height in the radial direction of the outer peripheral surface of the development sleeve 446. The waveform w1 indicates a variation in height in the radial direction of the outer peripheral surface of the development sleeve 446. The outer-peripheral-surface deflection is obtained by calculating a difference d1 between the maximum value and the minimum value of the heights indicated by the waveform w1.

Measurement Method 1 of Groove Deflection

The groove deflection is obtained on the basis of the height in the radial direction of the outer peripheral surface of the development sleeve 446 and the depth of the groove 448.

Figure 7:
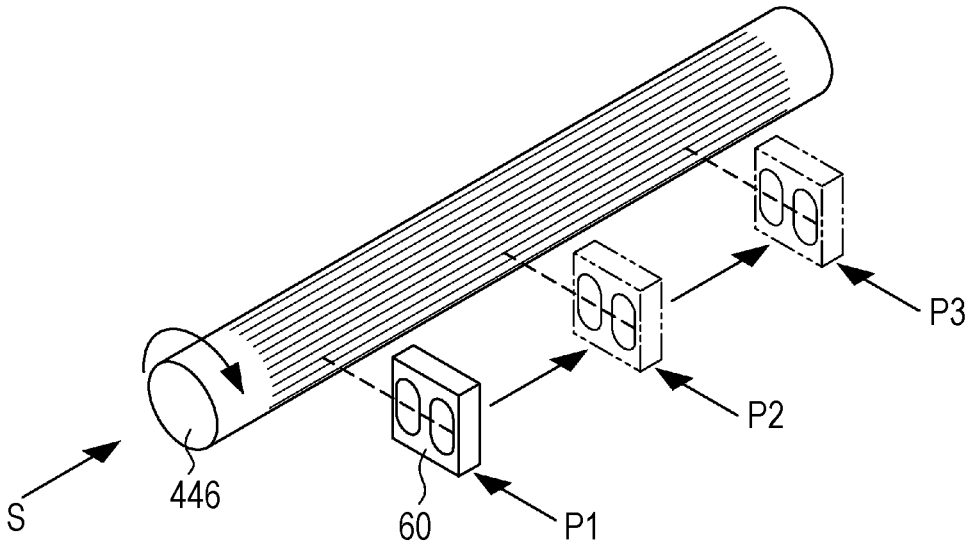
FIG. 7 illustrates an example of a method of measuring a depth of a groove.
Figure 8:
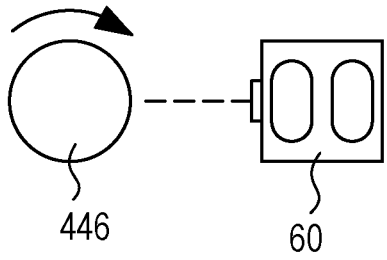
FIG. 8 is an illustration of the development sleeve and a laser displacement gauge shown in FIG. 7 when viewed in an arrow S direction in FIG. 7.

FIG. 7 illustrates an example of a method of measuring a depth of the groove 448. In the example in FIG. 7, the depth of the groove 448 is measured by using a laser displacement gauge 60. FIG. 8 is an illustration of the development sleeve 446 and the laser displacement gauge 60 shown in FIG. 7 when viewed in an arrow S direction in FIG. 7.

In the example in FIGS. 7 and 8, the depth of the groove 448 is measured for three portions of a first end portion, a center portion, and a second end portion of the development sleeve 446 by using the laser displacement gauge 60. First, the laser displacement gauge 60 is arranged at a position P1 facing the first end portion of the development sleeve 446, and irradiates the first end portion of the development sleeve 446 with laser light along the direction normal to the development sleeve 446. In this state, the development sleeve 446 is rotated at a constant speed, and the distance from the laser displacement gauge 60 to the development sleeve 446 is continuously measured. Accordingly, the depths of the grooves 448 at the first end portion of the development sleeve 446 are measured. Then, the laser displacement gauge 60 is moved to a position P2 facing the center portion of the development sleeve 446, and repeats steps similar to the above-described steps. Accordingly, the depths of the grooves 448 at the center portion of the development sleeve 446 are measured. Then, the laser displacement gauge 60 is moved to a position P3 facing the second end portion of the development sleeve 446, and steps similar to the above-described steps. Accordingly, the depths of the grooves 448 at the second end portion of the development sleeve 446 are measured.

Figure 9:
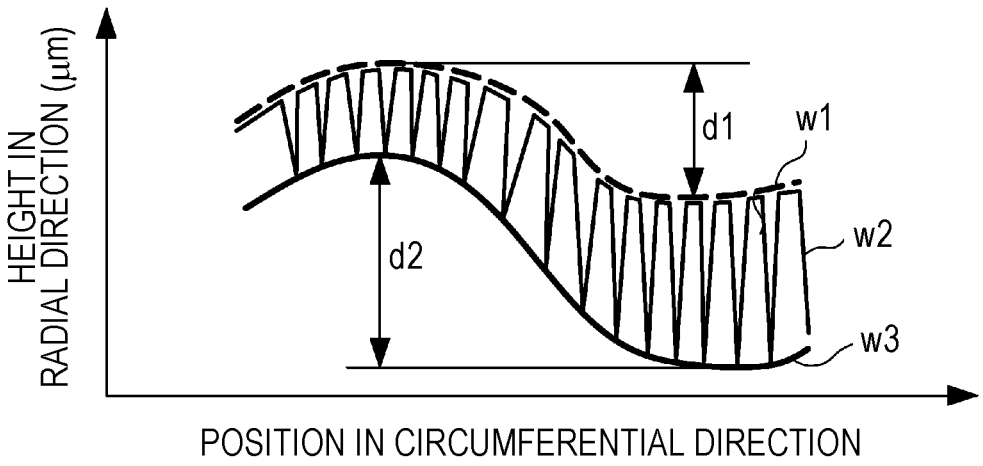
FIG. 9 illustrates an example of a composite waveform of the waveform indicative of the measurement result of the deflection measurement device and a waveform indicative of a measurement result of the laser displacement gauge.

FIG. 9 illustrates an example of a composite waveform w2 of the waveform w1 indicative of the measurement result of the deflection measurement device 50 and a waveform indicative of a measurement result of the laser displacement gauge 60. In FIG. 9, the horizontal axis indicates the position in the circumferential direction of the development sleeve 446, and the vertical axis indicates the height in the radial direction of the development sleeve 446. The waveform w2 is obtained by composing the waveform w1 indicative of the measurement result of the deflection measurement device 50 and the waveform indicative of the measurement result of the depth of the groove 448 of the development sleeve 446 while the positions in the circumferential direction are aligned. If the bottom portions of the grooves 448 of the development sleeve 446 included in the waveform w2 are traced, a line w3 is obtained. The line w3 indicates the variation in height in the radial direction of the bottom portions of the grooves 448. Hence, the groove deflection is obtained by calculating a difference d2 between the maximum value and the minimum value of the heights indicated by the line w3.

Measurement Method 2 of Groove Deflection

Also, the groove deflection is obtained by a cumulative tolerance between the outer-peripheral-surface deflection of the development sleeve 446 and the variation in depth of the groove 448. The variation in depth of the groove 448 indicates an error of the depth of the groove 448. The variation in depth of the groove 448 is obtained as follows.

Figure 10:
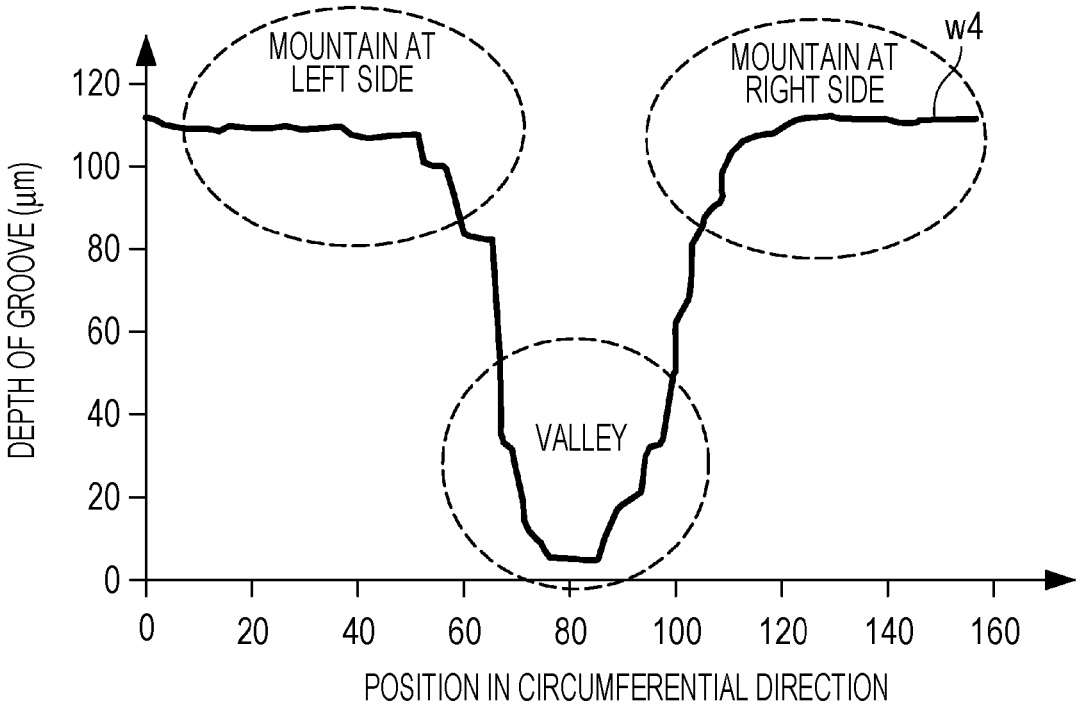
FIG. 10 illustrates an example of a waveform indicative of a measurement result of the deflection measurement device.

FIG. 10 illustrates an example of a waveform w4 indicative of a measurement result of the laser displacement gauge 60. In FIG. 10, the horizontal axis indicates the position in the circumferential direction of the development sleeve 446, and the vertical axis indicates the depth of the groove 448. The waveform w4 indicates the measurement result of a single groove 448. A mountain portion of the waveform w4 indicates the outer peripheral surface of the development sleeve 446. A valley portion of the waveform w4 indicates the groove 448 of the development sleeve 446. In this case, when ML is the maximum value of the mountain at the left side of the waveform w4, MR is the maximum value of the mountain at the right side, and V is the minimum value of the valley, the depth of the groove 448 is calculated by Expression (1) as follows.

$$\text{Depth of groove} = \frac{(ML + MR)}{2} - V \tag{1}$$

With aforementioned Expression (1), the depth of the groove 448 is calculated at three positions for each of all the grooves 448 formed in the development sleeve 446. By calculating the difference between the maximum value and the minimum value of the calculated depths of each groove 448, a variation in depth of the groove 448 is obtained.

For example, if a tolerance is 3σ, a square root of the sum of squares of the outer-peripheral-surface deflection and the variation in depth of the groove 448 may be used as a cumulative tolerance. In this case, the groove deflection is calculated by Expression (2). Expression (2) assumes that A is an outer-peripheral-surface deflection and B is a variation in depth of the groove 448.

$$\text{Groove deflection} = \sqrt{(A^2 + B^2)} \tag{2}$$

With aforementioned Expression (2), if the outer-peripheral-surface deflection is equal to or smaller than 25 μm, as long as the variation in depth of the groove 448 is equal to or smaller than 25 μm, the groove deflection becomes equal to or smaller than 35 μm. Hence, when the measurement method 2 of the groove deflection is employed, the outer-peripheral-surface deflection is preferably larger than 20 μm and equal to or smaller than 25 μm, or larger than about 20 μm and equal to or smaller than about 25 μm; and the variation in depth of the groove 448 is preferably equal to or smaller than 25 μm, or equal to or smaller than about 25 μm.

EXAMPLES

Next, examples of the present invention are described. FIG. 11 illustrates outer-peripheral-surface deflections and groove deflections of development rollers 443-1 to 443-6 according to Examples 1 to 6 and development rollers 543-1 to 543-10 according to Comparative Examples 1 to 10. The development rollers 443-1 to 443-6 according to Examples 1 to 6 and the development rollers 543-1 to 543-10 according to Comparative Examples 1 to 10 have mutually different outer-peripheral-surface deflections and groove deflections.

The development roller 443-1 according to Example 1 has an outer-peripheral-surface deflection of 27 μm, and a groove deflection of 31 μm. The development roller 443-2 according to Example 2 has an outer-peripheral-surface deflection of 23 μm, and a groove deflection of 30 μm. The development roller 443-3 according to Example 3 has an outer-peripheral-surface deflection of 23 μm, and a groove deflection of 30 μm. The development roller 443-4 according to Example 4 has an outer-peripheral-surface deflection of 21 μm, and a groove deflection of 27 μm. The development roller 443-5 according to Example 5 has an outer-peripheral-surface deflection of 25 μm, and a groove deflection of 31 μm. The development roller 443-6 according to Example 6 has an outer-peripheral-surface deflection of 26 μm, and a groove deflection of 33 μm.

As described above, the development rollers 443-1 to 443-6 according to Examples 1 to 6 each have an outer-peripheral-surface deflection being larger than 20 μm and smaller than 30 μm, and a groove deflection being equal to or smaller than 35 μm.

The development roller 543-1 according to Comparative Example 1 has an outer-peripheral-surface deflection of 12 μm, and a groove deflection of 18 μm. The development roller 543-2 according to Comparative Example 2 has an outer-peripheral-surface deflection of 8 μm, and a groove deflection of 17 μm. The development roller 543-3 according to Comparative Example 3 has an outer-peripheral-surface deflection of 7 μm, and a groove deflection of 17 μm. The development roller 543-4 according to Comparative Example 4 has an outer-peripheral-surface deflection of 20 μm, and a groove deflection of 25 μm. The development roller 543-5 according to Comparative Example 5 has an outer-peripheral-surface deflection of 13 μm, and a groove deflection of 19 μm. The development roller 543-6 according to Comparative Example 6 has an outer-peripheral-surface deflection of 35 μm, and a groove deflection of 42 μm. The development roller 543-7 according to Comparative Example 7 has an outer-peripheral-surface deflection of 30 μm, and a groove deflection of 35 μm. The development roller 543-8 according to Comparative Example 8 has an outer-peripheral-surface deflection of 21 μm, and a groove deflection of 36 μm. The development roller 543-9 according to Comparative Example 9 has an outer-peripheral-surface deflection of 16 μm, and a groove deflection of 21 μm. The development roller 543-10 according to Comparative Example 10 has an outer-peripheral-surface deflection of 15 μm, and a groove deflection of 21 μm.

As described above, the development rollers 543-1 to 543-10 according to Comparative Examples 1 to 10 each have an outer-peripheral-surface deflection being equal to or smaller than 20 μm or equal to or larger than 30 μm, or a groove deflection being larger than 35 μm. To be more specific, any of the development rollers 543-1 to 543-5, 543-9, and 543-10 according to Comparative Examples 1 to 5, 9, and 10 has a groove deflection being equal to or smaller than 35 μm; however, an outer-peripheral-surface deflection being equal to or smaller than 20 μm. The development roller 543-6 according to Comparative Example 6 has an outer-peripheral-surface deflection being equal to or larger than 30 μm, and a groove deflection being larger than 35 μm. The development roller 543-7 according to Comparative Example 7 has a groove deflection being equal to or smaller than 35 μm; however, has an outer-peripheral-surface deflection being equal to or larger than 30 μm. The development roller 543-8 according to Comparative Example 8 has an outer-peripheral-surface deflection being smaller than 30 μm; however, a groove deflection being larger than 35 μm.

The outer-peripheral-surface deflection is measured by using the deflection measurement device 50 (manufactured by Tokyo Opto-Electronics Co., Ltd., automatic roller measurement system, model No.: RSV-660) with the method described according to the exemplary embodiment. The groove deflection is measured with the measurement method 2 of the groove deflection described according to the exemplary embodiment. Also, the depth of the groove 448 used in the measurement method 2 of the groove deflection is measured by using the laser displacement gauge 60 (manufactured by Keyence Corporation, model No.: LT-9500, corresponding measurement unit: LT-9010) with the method shown in FIGS. 7 and 8.

The inventors study about density unevenness of a developed image by using each of the development rollers 443-1 to 443-6 according to Examples 1 to 6 and the development rollers 543-1 to 543-10 according to Comparative Examples 1 to 10. To be specific, each of the development rollers 443-1 to 443-6 according to Examples 1 to 6 and the development rollers 543-1 to 543-10 according to Comparative Examples 1 to 10 is installed in the developing device 44M of the image forming apparatus 1 (manufactured by Fuji Xerox Co., Ltd., DocuCentre-IV C2260), and a test chart of magenta with an image density of 65% is formed under an environment of a temperature of 10° C. and a humidity of 15% RH. Then, in the formed test chart, a color difference generated at a pitch period of the development roller 443 is measured.

Figure 12:
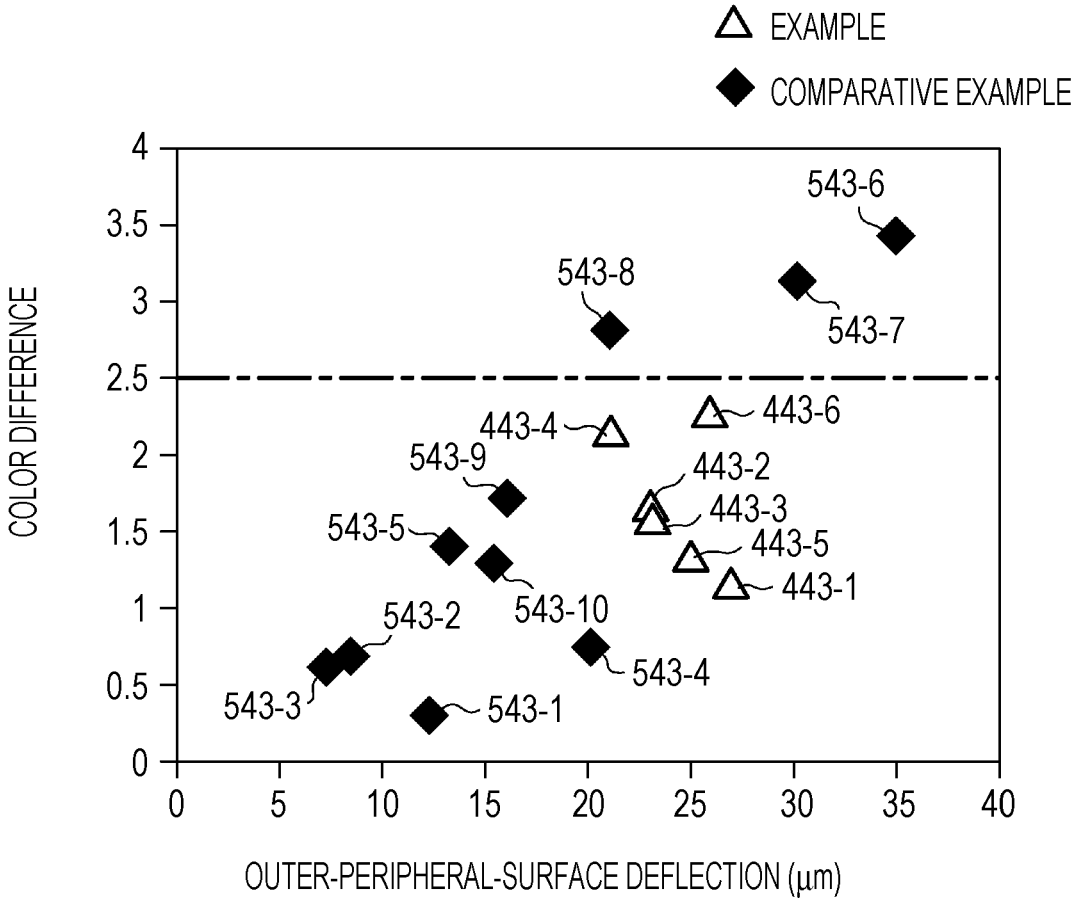
FIG. 12 illustrates a relationship between the outer-peripheral-surface deflections and color differences of the development rollers according to according to Examples 1 to 6 and the development rollers according to Comparative Examples 1 to 10.
Figure 13:
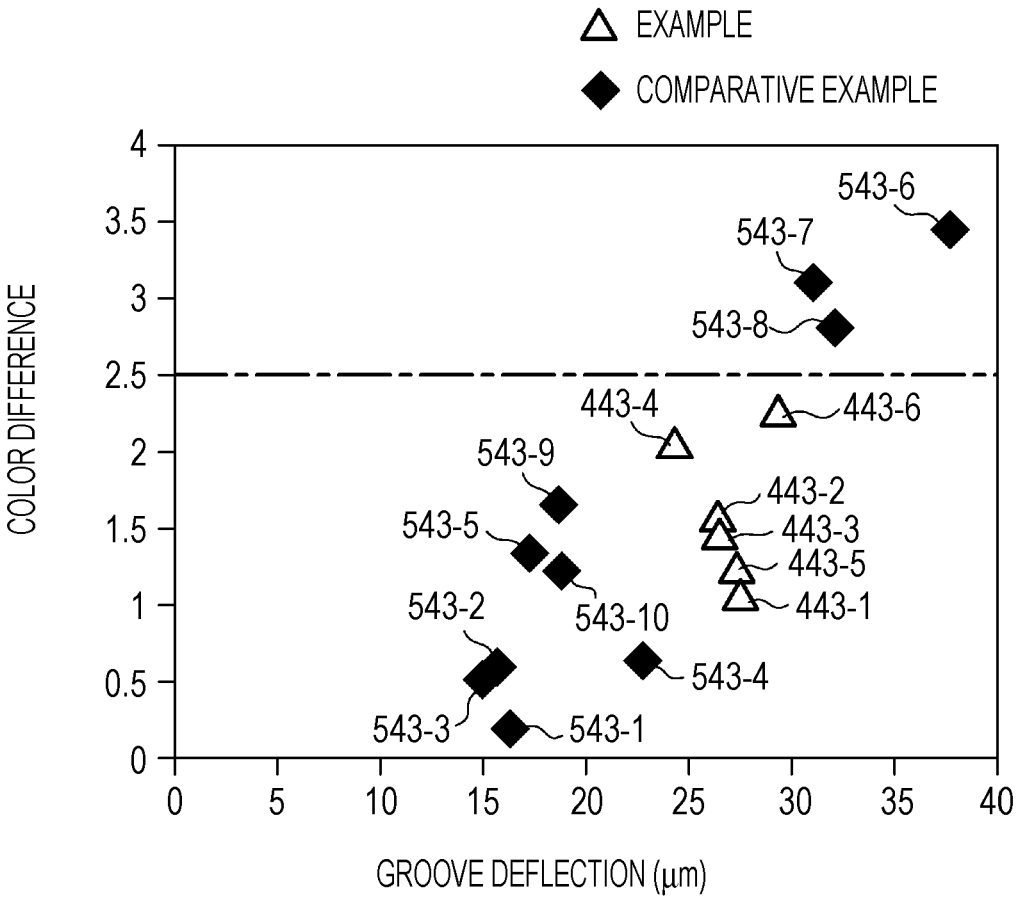
FIG. 13 illustrates a relationship between the groove deflections and the color differences of the development rollers according to Examples 1 to 6 and the development rollers according to Comparative Examples 1 to 10.

FIG. 12 illustrates a relationship between the outer-peripheral-surface deflections and color differences of the development rollers 443-1 to 443-6 according to Examples 1 to 6 and the development rollers 543-1 to 543-10 according to Comparative Examples 1 to 10. In FIG. 12, the horizontal axis indicates the outer-peripheral-surface deflection and the vertical axis indicates the color difference. FIG. 13 illustrates a relationship between the groove deflections and the color differences of the development rollers 443-1 to 443-6 according to Examples 1 to 6 and the development rollers 543-1 to 543-10 according to Comparative Examples 1 to 10. In FIG. 13, the horizontal axis indicates the groove deflection and the vertical axis indicates the color difference. In the examples shown in FIGS. 12 and 13, the density unevenness has a reference value of a color difference being 2.5. In this case, if the color difference is equal to or smaller than the reference value, the density unevenness is recognized as an allowable level.

As shown in FIGS. 12 and 13, in case of using any of the development rollers 443-1 to 443-6 according to Examples 1 to 6, the color difference of an image is equal to or smaller than the reference value. In contrast, in case of using any of the development rollers 543-6 to 543-8 according to Comparative Examples 6 to 8, the color difference of an image is larger than the reference value. As described above, the development roller 543-6 according to Comparative Example 6 has an outer-peripheral-surface deflection being equal to or larger than 30 μm, and a groove deflection being larger than 35 μm. The development roller 543-7 according to Comparative Example 7 has a groove deflection being equal to or smaller than 35 μm; however, has an outer-peripheral-surface deflection being equal to or larger than 30 μm. The development roller 543-8 according to Comparative Example 8 has an outer-peripheral-surface deflection being smaller than 30 μm; however, has a groove deflection being larger than 35 μm. Regarding this result, it is recognized that the density unevenness of an image is the allowable level if the outer-peripheral-surface deflection is smaller than 30 μm and the groove deflection is equal to or smaller than 35 μm.

Also, focusing on Comparative Examples 1 to 5, 9, and 10, as shown in FIGS. 12 and 13, if any of the development rollers 543-1 to 543-5, 543-9, and 543-10 according to Comparative Examples 1 to 5, 9, and 10 is used, the color difference is equal to or smaller than the reference value. However, as described above, any of the development rollers 543-1 to 543-5, 543-9, and 543-10 according to Comparative Examples 1 to 5, 9, and 10 has an outer-peripheral-surface deflection being equal to or smaller than 20 μm. If the outer-peripheral-surface deflection is equal to or smaller than 20 μm, the defective rate during manufacturing is increased, and the productivity is decreased.

Figure 14:
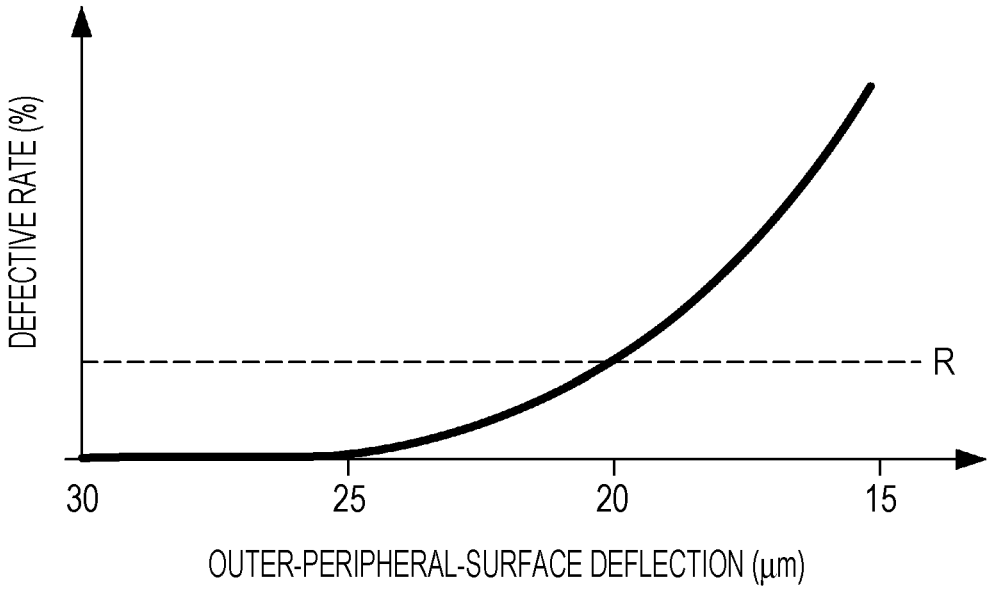
FIG. 14 illustrates an example of a defective rate during manufacturing the development sleeve.

FIG. 14 illustrates an example of a defective rate during manufacturing the development sleeve 446. In FIG. 14, the horizontal axis indicates the outer-peripheral-surface deflection and the vertical axis indicates the defective rate during manufacturing. In the example in FIG. 14, if the outer-peripheral-surface deflection is equal to or smaller than 20 μm, the defective rate is rapidly increased. In this case, the productivity is decreased, and the manufacturing cost is increased. In contrast, according to this exemplary embodiment, if the outer-peripheral-surface deflection is allowed to be larger than 20 μm, the deflection rate during manufacturing of the development sleeve 446 is equal to or smaller than a reference value R. In this case, as compared with a case in which the outer-peripheral-surface deflection is equal to or smaller than 20 μm, the productivity is increased. As the result, the manufacturing cost is decreased.

Also, if the above-described measurement method 2 of the groove deflection is employed, by using aforementioned Expression (2), the variation in depth of the groove 448 is allowed to be 25 μm at maximum as long as the outer-peripheral-surface deflection is larger than 20 μm and equal to or smaller than 25 μm. Regarding the variation in depth of the groove 448, similarly to the outer-peripheral-surface deflection, the defective rate is decreased if the precision of variation is relaxed. Also, in the example in FIG. 14, even if the outer-peripheral-surface deflection is larger than 20 μm and equal to or smaller than 25 μm, the defective rate is equal to or smaller than the reference value R. Hence, in this case, the productivity is further increased.

Also, focusing on Comparative Example 8, as shown in FIG. 12, the development roller 543-8 according to Comparative Example 8 has a smaller outer-peripheral-surface deflection than those of the development rollers 443-1 to 443-3, 443-5, and 443-6 according to Examples 1 to 3, 5, and 6; however, the color difference of an image developed by using the development roller 543-8 according to Comparative Example 8 is larger than the reference value. As shown in FIG. 13, this is because the groove deflection of each of the development rollers 443-1 to 443-3, 443-5, and 443-6 according to Examples 1 to 3, 5, and 6 is equal to or smaller than 35 μm, whereas the groove deflection of the development roller 543-8 according to Comparative Example 8 is 36 μm and hence is larger than 35 μm.

Since related art considers only the outer-peripheral-surface deflection, in such a case, the outer-peripheral-surface deflection has had to be restricted to a further small value, for example, a value equal to or smaller than 20 μm, with regard to the outer-peripheral-surface deflection of the development roller 543-8 according to Comparative Example 8 to make the density unevenness of an image to meet the allowable level. In contrast, in this exemplary embodiment, the density unevenness of an image meets the allowable level as long as the groove deflection is equal to or smaller than 35 μm even if the outer-peripheral-surface deflection is larger than 20 μm. That is, the outer-peripheral-surface deflection is allowed to be larger than 20 μm as long as the groove deflection is equal to or smaller than 35 μm.

With this exemplary embodiment, since both the outer-peripheral-surface deflection and the groove deflection are restricted, the productivity of the development sleeve 446 is increased and the density unevenness of a developed image is restricted. Also, with the above-described measurement method 2 of the groove deflection, since the groove deflection is calculated on the basis of the outer-peripheral-surface deflection and the variation in depth of the groove 448, the groove deflection is easily restricted.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A development roller comprising:

a substantially cylindrical development sleeve that has an axis and rotates about the axis; and a magnet portion that is provided in the development sleeve and has a plurality of magnetic poles, wherein the development sleeve has a surface and a groove in the surface along a direction of the axis, and wherein the development sleeve has an outer peripheral surface and the groove has a bottom portion, the development sleeve having a magnitude of a displacement of the outer peripheral surface in a radial direction of the development sleeve when the development sleeve is rotated being larger than about 20 μm and smaller than about 30 μm, and a magnitude of a displacement the bottom portion in the radial direction when the development sleeve is rotated being equal to or smaller than about 35 μm.

2. The development roller according to claim 1, wherein the deflection of the outer peripheral surface is larger than about 20 μm and equal to or smaller than about 25 μm, and the groove has a depth with an error being equal to or smaller than about 25 μm.

3. A developing device comprising:

a housing portion that houses a developer containing a toner and a carrier; and the development roller according to claim 1, the development roller being provided in the housing portion, and configured to hold the developer on the surface and transport the developer.

4. An image forming apparatus comprising:

a photoconductor;

a charging device that charges the photoconductor with electricity;

an exposure device that exposes the charged photoconductor to light, and forms an electrostatic latent image;

the developing device according to claim 3 that develops the electrostatic latent image by using the toner and forms an image;

a transfer device that transfers the image on a recording medium; and a fixing device that fixes the image to the recording medium.

* * * * *